US006613149B1

(12) United States Patent
Jung et al.

(10) Patent No.: US 6,613,149 B1
(45) Date of Patent: Sep. 2, 2003

(54) BANDEROLE GLUING APPARATUS AND METHOD

(75) Inventors: Thomas Jung, Bayreuth (DE); Thomas Kremer, Kulmbach (DE)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/448,547

(22) Filed: Nov. 23, 1999

(30) Foreign Application Priority Data

Nov. 27, 1998 (EP) ..... 98122510

(51) Int. Cl.[7] ..... B05C 3/02
(52) U.S. Cl. ..... 118/411; 118/419
(58) Field of Search ..... 156/578, DIG. 30, 156/DIG. 34; 118/411, 419, 315; 222/485

(56) References Cited

U.S. PATENT DOCUMENTS 3,088,433 A * 5/1963 Walter et al.
3,556,832 A * 1/1971 Parks
3,991,917 A * 11/1976 Moen
4,157,149 A * 6/1979 Moen ..... 118/411
4,391,856 A * 7/1983 McIntyre et al.
4,466,378 A * 8/1984 Rogers et al.
4,476,165 A * 10/1984 McIntyre ..... 118/411
4,675,230 A * 6/1987 Innes ..... 118/411
4,687,137 A * 8/1987 Boger et al.
5,000,988 A * 3/1991 Inoue et al.
5,129,356 A * 7/1992 Bandy et al.
6,206,963 B1 * 3/2001 Abrahams

* cited by examiner

*Primary Examiner*—Brenda A. Lamb
(74) *Attorney, Agent, or Firm*—John F. Salazar; Charles G. Lamb; Middleton Reutlinger

(57) ABSTRACT

The invention relates to an apparatus and a method for applying glue to banderoles, more particularly banderoles for cigarette packs, comprising a glue supply, a nozzle device (7, 9, 12), a guide for the banderoles to be glued and a means for controlling glue delivery, whereby the nozzle device (7, 9, 12) comprises a glue distributor (7) which applies the glue in two streaks to the banderole by a continual contact process.

7 Claims, 3 Drawing Sheets

BANDEROLE GLUING APPARATUS AND METHOD

BACKGROUND OF THE INVENTION

1. Field of the Invention

The invention relates to an apparatus for applying glue to banderoles. More particularly, the invention concerns an apparatus for applying glue to banderoles for cigarette packs, preferably stamps, said apparatus comprising a glue supply, a nozzle device, a guide for the banderoles to be glued and a means of controlling glue delivery, wherein said nozzle device comprises a glue distributor which applies the glue in two or more streaks to the banderole by a continual contact process.

Once the cigarettes in the production sequence have been introduced into the pack and the pack closed, the stamp banderole is attached to the pack in such a way that, on opening of the pack, it tears and is thus cancelled.

Such stamp banderoles, in various sizes, paper qualities and thicknesses, are conventionally glued by means of a roll gluing method, for instance, as corner or rear banderoles for bonding to so-called HL packs. In such a roll gluing method, the glue is taken up from a glue pot by rollers and is continually applied to the banderoles. Banderole gluing is normally carried out at the so-called cellophane machine in the production line, at a stand-alone cellophane machine, or in a stand-alone banderole rolling machine.

The advantage of this method of glue application lies particularly in the fact that the apparatus used has a simple mechanical structure and permits a continuous application of the glue.

The drawbacks of the roll gluing method are the open glue pot and glue losses when washing out the pot after a lengthy standstill or at the end of production. Furthermore, the glue is extremely stressed mechanically due to the continuous rotation of the gluing rollers in glue, which may lead to destruction of the polymer structure of the glue. This in turn results in changes in temperature and viscosity which make application difficult or even impossible. Also disadvantageous is the lack of sufficient flexibility in adapting to changes in the length or amount of the streak of glue applied. Another nuisance is the limited choice of cold glues. Since the banderoles greatly differ in paper quality and with regard to their restoring forces, the gluing apparatus actually needs to be very quickly adaptable to glues having other transfer properties and other viscosities, which is, however, hardly possible with roll gluers since changing to a lesser viscosity detriments the transfer properties of the rollers.

2. Description of Prior Art

Known from German patents DE 196 47 670 A1 and DE 196 05 251 A1 are gluers and gummers in which a glue or gum is applied via spray nozzles, a separate spray nozzle being used for each streak of glue. Disadvantageous in such spray application methods using separate nozzles is the high investment costs. Furthermore, any spray application always involves glue losses when the spray jet is off-target, as a result of which surrounding components often need to be cleaned.

Known from German patent DE 44 37 764 A1 is a glue applying apparatus incorporating a nozzle plate for distributing the glue to a plurality of outlets, which have a very small diameter and apply only short streaks of glue intermittently.

SUMMARY OF THE INVENTION

It is thus the object of the present invention to propose an apparatus and a method for gluing banderoles which overcome the disadvantages of the prior art. More particularly, the intention is to enable banderoles to be easily provided with glues differing in viscosity, without spraying being necessary, and thus without having to tolerate the accompanying risk of spillage or soiling. Furthermore, it is intended that gluing be undertaken using a relatively simple apparatus while permitting guidance of the banderoles between the glue application positions.

This object is achieved in accordance with the invention in that the nozzle device of the banderole gluing apparatus is provided with a glue distributor which applies the glue in two streaks to the banderole by a continual contact process.

In the continual contact process as cited above, the glue is not sprayed, but instead emerges from the nozzle device as a continuous stream. The application tip of the nozzle device is thereby arranged so close to the passing banderole that the process involved may be essentially termed a contact process. The glue is advantageously applied continuously to a banderole so that a later reliable conglutination of the banderole is assured. The glue distributor is so configured that it can apply in two streaks the glue to the banderole so that space remains between the individual glue distributor application tips in order to build in a transport or guide means for the banderole.

Because glue application takes place continuously via the nozzle device, optimizing the amounts of glue dispensed is very simple and the spectrum of glues used may be optimized to glues greatly differing in viscosity, likewise, including glues having a higher solids content and a higher wet bonding force.

Moreover, the molecular structure of the glue is no longer destroyed, and open glue pots are eliminated.

In one preferred embodiment of the present invention, the glue distributor is a nozzle header, configured U-shaped or having the shape of a tuning fork. Due to this configuration, a very simple device is made available which permits multi-streak glue application, since merely the nozzle header of the complete nozzle device is modified. In particular, this configuration of the apparatus makes it suitable for incorporating a transport or guide means between the legs of the nozzle header so that centering the banderoles is rendered possible.

Preferably, a nozzle plate is arranged at the discharge tip of each nozzle header fork or each nozzle header leg, the edges of the nozzle plate being rounded for banderole guidance. Rounding the edges in this way ensures that the flat banderoles are not obstructed in their progress or shifted out of place, i.e., cannot become trapped at the front ends of the nozzle plates which pass very closely by them.

As already mentioned the nozzle plates are provided for applying the glue in a continual contact process. For this purpose, they are a mere 0.1 mm to 0.3 mm, preferably a mere 0.2 mm, away from the banderoles passing by their discharge tip.

The nozzle device is advantageously configured so that it deposits a continuous stream of glue or continuous streaks of glue to the banderoles, i.e., the means for controlling glue delivery ensures that each banderole is glued continuously with two or more streaks without any intermittent glue pattern materializing.

For transporting the banderole, in one preferred embodiment of the invention, a transport roller is arranged between the nozzle header forks, its outer circumference protruding slightly over the front ends of the nozzle plates. Such a transport roller supports additional centering of the banderole and ensures that advancement can take place without dislocating the banderoles.

In one preferred embodiment of the present invention, the nozzle device is applied to a mount so that it permits variable positioning in order to enable suitable vernier adjustments to be made. In addition, given a lengthy break in production (>30 sec), the nozzle device is pneumatically moved away from the glue application position to the right and, upon this longitudinal movement, the nozzle orifices are sealed off by two spring-mounted (27) and cam-guided legs (26).

It is particularly of advantage to configure the apparatus in accordance with the invention such that the dimensions of the nozzle device and the details of its supporting fixture enable the apparatus to be functionally incorporated in the mounting fixture of a conventional glue pot roll gluing unit, i.e. the fixtures of the apparatus in accordance with the invention are configured so that it can directly replace a glue pot roller applicator on a cellophane machine. For this purpose, the dimensions of the nozzle device also need to be configured, of course, so that the application tip is in direct contact with the passing banderoles. With such a configuration, the gluing apparatus can be very quickly adapted to different banderole qualities since, by means of the banderole gluing apparatus in accordance with the invention, glues which differ greatly in viscosity and composition can be easily applied.

In the method in accordance with the invention use is made of a glue supply, a nozzle device, a guide for the banderoles to be glued and a means of controlling glue delivery, whereby the glue is applied in continual contact by means of a glue distributor in two or more streaks to the banderole. The advantages achievable thereby have already been discussed above. In particular, the glue is dispensed as a continual flow of glue from nozzle plates arranged at the discharge tip of the glue distributor. In one preferred embodiment of the gluing method in accordance with the invention, the glue is applied as a continuous streak of glue from a point in the vicinity of the first end of the banderole to a point in the vicinity of the second end of the banderole. Such a continuous streak of glue ensures reliable conglutination of the banderoles to a cigarette pack. In the method in accordance with the invention, an apparatus, as described above in the various forms, can be used.

BRIEF DESCRIPTION OF THE DRAWINGS

The invention will now be described in more detail with reference to the drawings in which.

DESCRIPTION OF THE PREFERRED EMBODIMENTS

Figure 1:
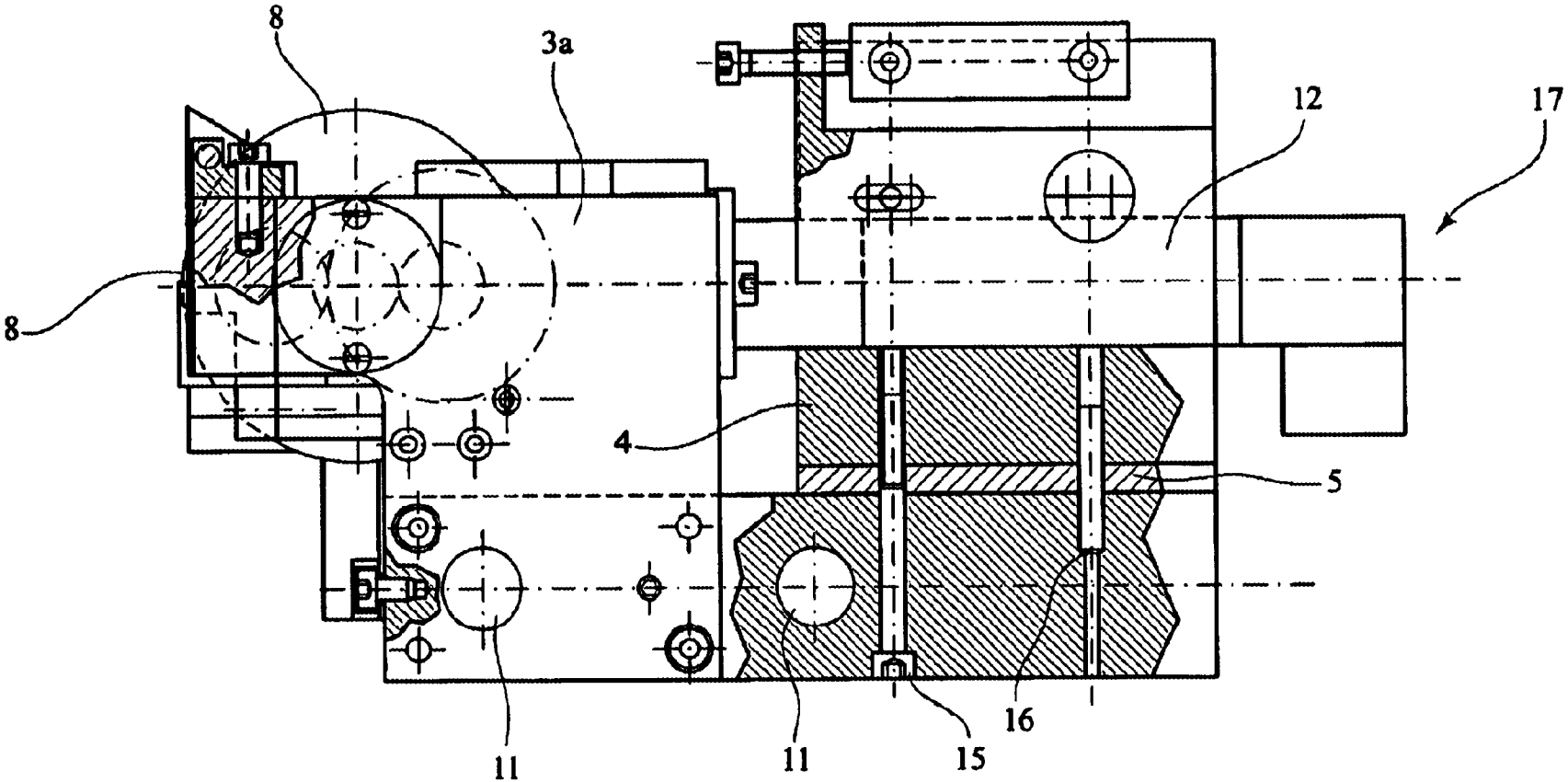
FIG. 1 is a partly sectioned side view of a banderole gluing apparatus in accordance with the invention, illustrating the nozzle device and support thereof.

Referring now to FIG. 1, illustrated in more detail is how a nozzle body 12 is secured to a support. This support serves to secure the nozzle device to the cellophane machine, it being located via the holes 11 on the bolts protruding from the machine for this purpose, after which it is suitably fixed in place. It is to be noted particularly in this, respect that the holes 11 are dimensioned and arranged so that any gluing device, otherwise secured to the cellophane machine, can be replaced without problem by the gluing apparatus in accordance with the invention as shown. The transport roller 8 and the nozzle plate 6, as detailed later, are likewise adapted for their positioning.

The nozzle body 12 of the nozzle device is secured to the right rear side of the support, with the inclusion of a distance plate 5 and a so-called adjuster bracket 4 such that the level and alignment of the nozzle body 12 can be fixed by means of a screw 15 and via a dowel pin 16, i.e., the thickness of the distance plate 5 and the angle of the adjuster bracket 4 sets and positions the nozzle body 12. The glue supply takes place at the rear end 17 of the nozzle body 12, the delivery being regulated by a control means (not shown). Likewise not shown, but actually provided in practice, is a glue application position control which determines whether a banderole is located at the glue application position. For this purpose, a linear path control is used which is commercially available and thus known in prior art. The glue is applied in synchrony with the speed of the machine by means of a coupled shaft encoder. Glue application is controlled by a switch—for example an initiator or light guide device—connected to the control.

Figure 2:
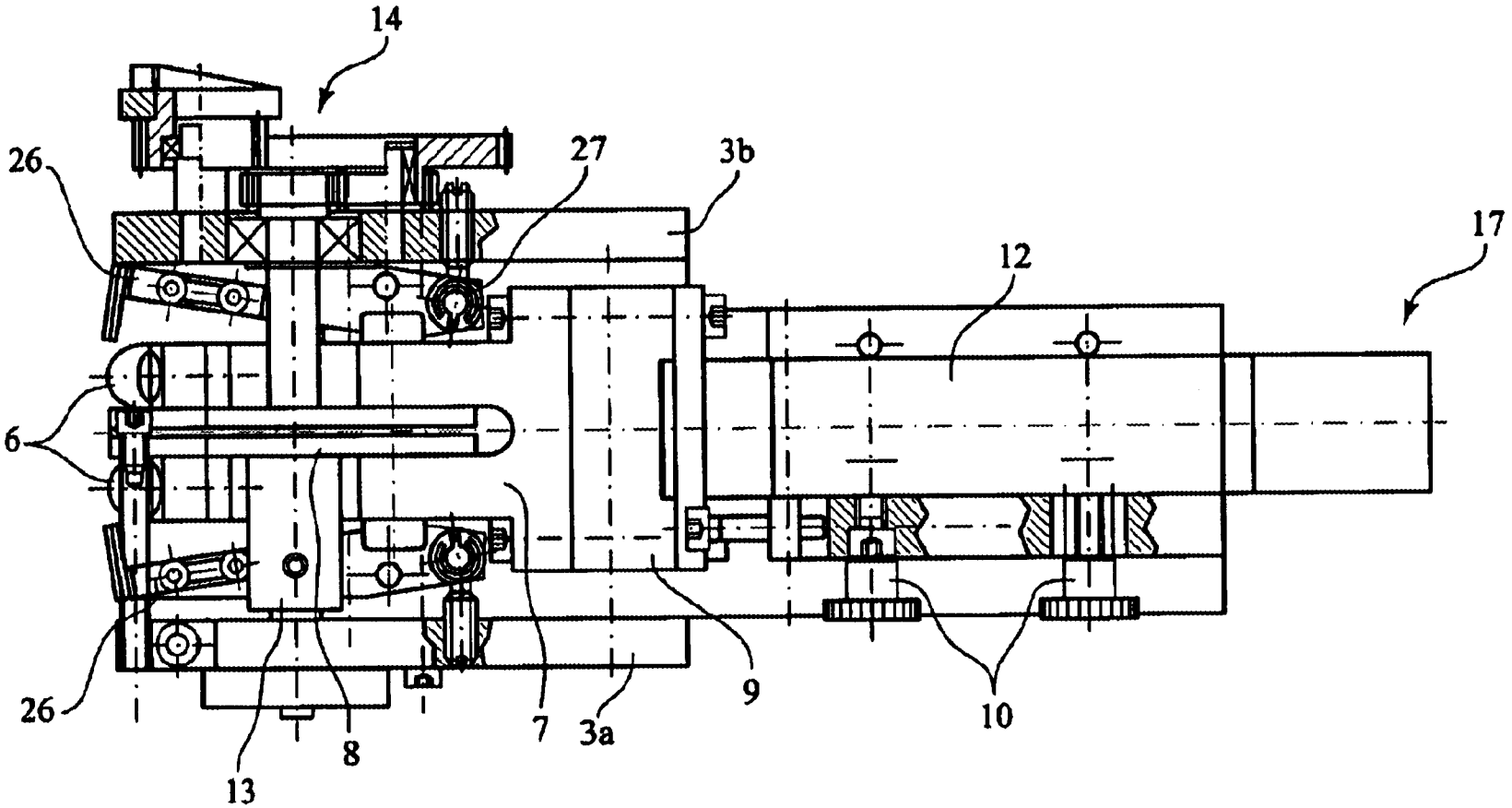
FIG. 2 is a view from above of the banderole gluing apparatus shown in FIG. 1.

FIG. 2 illustrates, at the left front end of the support, the fastening legs 3*a* and 3*b*, the main function of which is to mount the transport roller 8 and its drive 14. The drive 14 for the transport roller 8 comprises various spur gears and coupling elements and is connected to the drive of the machine. The transport roller 8 is mounted by its spindle 13 between the legs 3*a* and 3*b*, as evident from FIG. 2. It is furthermore evident from FIG. 1 that a part of the circumference of the transport roller 8 protrudes beyond the front left-hand edge of the gluing device, i.e., at the location where the banderoles are transported or guided by the transport roller 8.

Again in referring to FIG. 2, the configuration of the nozzle device in accordance with the invention is evident, it comprising the nozzle body 12, the valve head 9 and the nozzle header configured as a two-legged fork 7. The positioning of the nozzle body 12 may be furthermore defined by means of the knurled screws 10, where it is secured at the rear on the right.

From the valve head 9 outwards, the nozzle header is divided U-shaped or in the shape of a tuning fork in the two legs 7. In each of the legs 7, glue is delivered up to the front face end on the left where the nozzle plates 6 (which will be detailed later with reference to FIGS. 3 to 5) close off the arrangement. A continuous stream of glue emerges temporarily from each of the nozzle plates 6 for gluing each banderole. Since the left-hand face of each nozzle plate 6 is spaced a mere 0.2 mm away from the passing banderole, the method involved may be termed a contact gluing method.

Still referring now to FIG. 2, it can be clearly seen how the transport roller 8 is arranged between the legs 7 and is thus able to ensure centered transport and guidance of the banderoles. Accordingly, the banderoles receive optimal transport or guidance during the gluing process so that two, essentially parallel, streaks of glue are applied to the banderole on both sides of the transport roller, i.e., continuously from a point in the vicinity of the first end of the banderole to a point in the vicinity of the second end of the banderole. To prevent leakage of the glue during conglutination of the banderoles, a margin is left on all sides of the banderole when gluing around the periphery.

Figure 3:
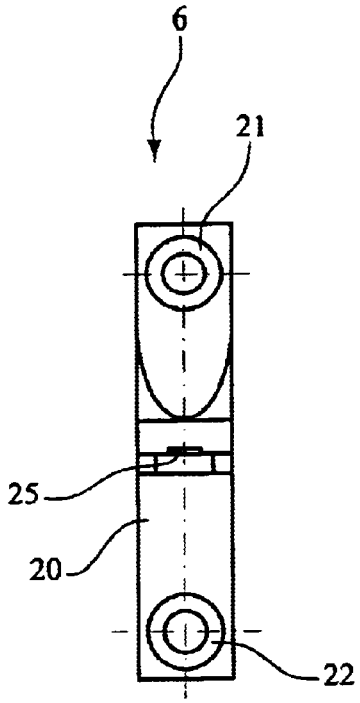
FIG. 3 is a front view of a nozzle plate as used in the apparatus in accordance with the invention.
Figure 4:
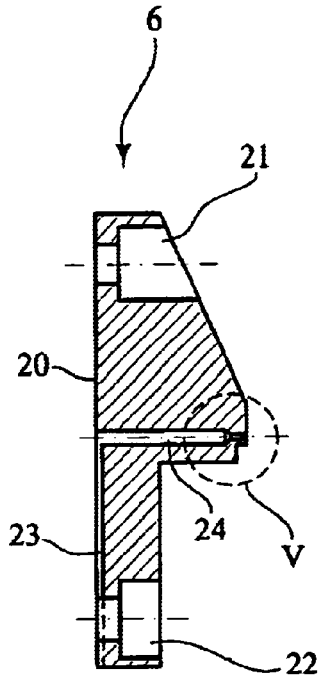
FIG. 4 is a side section view of the nozzle plate as shown in FIG. 3.
Figure 5:
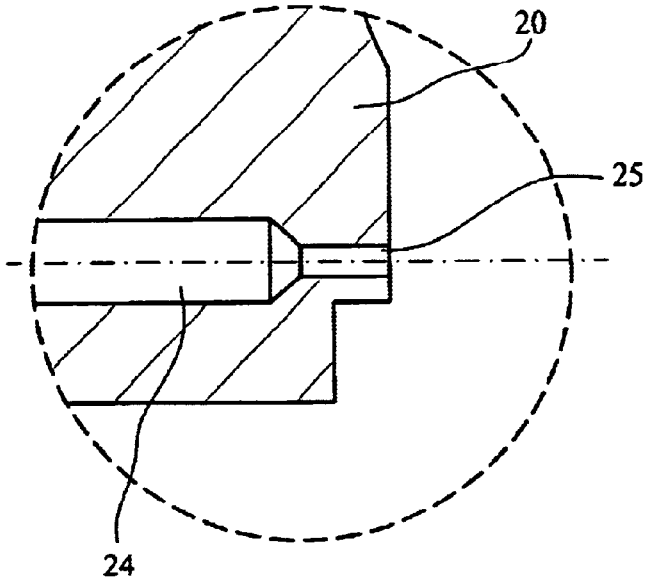
FIG. 5 is a magnified illustration of the detail V as shown in FIG. 4 to illustrate the nozzle orifice.

Referring now to FIGS. 3 to 5, illustrated is the configuration of a nozzle plate as used in a gluing device in accordance with the invention. The nozzle plate, in each case, is indicated by the reference numeral 6. The nozzle plate 6 consists of a base body 20 incorporating the necessary nozzle means. Openings or through-holes 21 and 22 are provided at the top and bottom of the body 20 for securing to the front end of the legs 7 (see FIG. 2), it being by means of these holes that the nozzle plate can be bolted to the front ends of the fork legs 7. As likewise best evident from FIG. 2, the nozzle plates 6 have rounded front edges which directly contact the banderoles or are spaced away therefrom by a mere 0.2 mm. These rounded edges ensure smooth passage of the transported banderoles and thus assure an uninterrupted gluing process.

On the rear side, i.e. at the side on which the nozzle plate 6 is attached to the face of one fork leg 7, the nozzle plate comprises an inlet passage 23, which can be seen in FIG. 4. Connected to this inlet passage 23 is a passage 24 which passes the glue through the nozzle plate 6 up to the discharge position. This discharge position is marked with a V in FIG. 4, and is shown again magnified in FIG. 5.

FIG. 5 shows how the passage 24 is constricted at the outlet and verges into a outlet passage 25 of very small diameter. As is evident from FIG. 3, the outlet passage 25 is configured tubular.

The glue emerges from this tubular outlet passage 25 and is continuously applied to the banderole which is transported lengthwise past the nozzle plate 6 (i.e., from top to bottom as shown in FIGS. 3 to 5). Each banderole is glued by application of a continuous streak of glue to the right and left of its centerline where, as already mentioned, the transport roller 8 is in contact but other designs are contemplated by the scope of the present invention.

Due to the continuous glue application with a continuous stream of glue, i.e., in an uninterrupted flow in gluing each banderole, reliable bonding is assured.

What is claimed is:

1. A glue application apparatus for use with banderoles on cigarette packs, comprising:

a nozzle device for application of glue, said nozzle device waving a nozzle header, said header having a first and second nozzle plate, each of said first and second nozzle plates having an inlet passage and an outlet passage, each of said outlet passages in close proximity to said banderoles;

a transport guide in frictional contact with said banderoles;

wherein said transport guide is comprised of a transport roller, said transport roller positioned between said first and second nozzle plate of said nozzle header.

2. The glue application apparatus of claim 1 further comprising a spindle extending between said first and second nozzle plate and through said transport roller.

3. The glue application apparatus of claim 2 further comprising a drive operably connected to said transport roller.

4. An apparatus for applying glue to banderoles, comprising:

a glue supply;

a nozzle device in fluid communication with said glue supply;

a guide for the banderoles to be glued;

wherein said nozzle device comprises a nozzle header, said nozzle header is comprised of two legs which extend in a manner so as to provide said nozzle header with a U-shape, wherein each said leg has a discharge tip such that said nozzle header discharges two or more streaks of the glue onto the banderoles by a continual contact processes.

5. The apparatus as set forth in claim 4, wherein arranged at said discharge tip of said nozzle header leg is a nozzle plate, edges of each of said nozzle plates are rounded towards the guide for the banderoles.

6. The apparatus as set forth in claim 5, wherein said nozzle plates are from 0.1 mm to 0.3 mm away from the banderoles passing by said discharge tips.

7. An apparatus for applying glue to banderoles, comprising:

a glue supply;

a nozzle device having a first and a second nozzle plate said nozzle device in fluid communication with said glue supply;

a guide for the banderoles to be glued;

wherein said nozzle device comprises a glue distributor which discharges two or more streaks of the glue onto the banderoles by a continual contact process;

wherein, for transporting banderoles, a transport roller is arranged between said nozzle plates, the outer circumference of said transport roller protruding slightly beyond front ends of said nozzle plates.

* * * * *

UNITED STATES PATENT AND TRADEMARK OFFICE

CERTIFICATE OF CORRECTION

PATENT NO. : 6,613,149 B1 
DATED : September 2, 2003
INVENTOR(S) : Thomas Jung and Thomas Kremer It is certified that error appears in the above-identified patent and that said Letters Patent is hereby corrected as shown below:

Column 1,
Line 64, after "intermittently." insert -- Such nozzle plates are expensive to produce and do not permit, on the other hand, guidance of the articles to be glued between the outlets. --;

Column 6,
Line 25, after "tip of" insert -- each --.

Signed and Sealed this

Eighteenth Day of May, 2004

JON W. DUDAS
*Acting Director of the United States Patent and Trademark Office*